US008066849B2

(12) United States Patent
Kokko et al.

(10) Patent No.: US 8,066,849 B2
(45) Date of Patent: Nov. 29, 2011

(54) ABSORBENT SHEET PREPARED WITH PAPERMAKING FIBER AND SYNTHETIC FIBER EXHIBITING IMPROVED WET STRENGTH

(75) Inventors: Bruce J. Kokko, Neenah, WI (US); Daniel W. Sumnicht, Hobart, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 99 days.

(21) Appl. No.: 12/456,097

(22) Filed: Jun. 11, 2009

(65) Prior Publication Data

US 2009/0308551 A1 Dec. 17, 2009

Related U.S. Application Data

(60) Provisional application No. 61/131,642, filed on Jun. 11, 2008.

(51) Int. Cl.
*D21H 13/12* (2006.01)
*D21H 13/20* (2006.01)
*D21H 21/18* (2006.01)

(52) U.S. Cl. ..... 162/146; 162/164.1; 162/164.3; 162/168.1; 162/169; 162/175; 162/177

(58) Field of Classification Search ..... 162/109, 162/111, 112, 113, 164.1–164.7, 168.1–168.7, 162/169, 175, 177
See application file for complete search history.

(56) References Cited

U.S. PATENT DOCUMENTS

| | | | | |
|---|---|---|---|---|
| 2,926,116 | A | 2/1960 | Keim | 164/164 |
| 2,926,154 | A | 2/1960 | Keim | 260/29.2 |
| 3,240,664 | A | 3/1966 | Earle, Jr. | 162/164 |
| 3,700,623 | A | 10/1972 | Keim | 260/80.3 R |
| 3,772,076 | A | 11/1973 | Keim | 117/155 R |
| 4,100,324 | A | 7/1978 | Anderson et al. | 428/288 |
| 4,210,487 | A * | 7/1980 | Driscoll | 162/146 |
| 4,307,143 | A | 12/1981 | Meitner | 252/91 |
| 4,426,417 | A | 1/1984 | Meitner et al. | 428/195 |
| 4,436,780 | A | 3/1984 | Hotchkiss et al. | 428/198 |
| 4,496,583 | A * | 1/1985 | Yamamoto et al. | 442/414 |
| 4,528,316 | A | 7/1985 | Soerens | 524/503 |
| 4,529,480 | A | 7/1985 | Trokhan | 162/109 |
| 4,621,020 | A * | 11/1986 | Tashiro et al. | 428/361 |
| 4,710,432 | A * | 12/1987 | Nishimura et al. | 428/542.8 |
| 4,735,849 | A | 4/1988 | Murakimi et al. | 428/224 |

(Continued)

FOREIGN PATENT DOCUMENTS

EP 1282506 B1 8/2008

(Continued)

OTHER PUBLICATIONS

Chapter 2: Alkaline-Curing Polymeric Amine-Epichlorohydrin by Espy in Wet Strength Resins and Their Application (L. Chan, Editor, 1994).

*Primary Examiner* — Eric Hug
*Assistant Examiner* — Peter Chin
(74) *Attorney, Agent, or Firm* — Laura L. Bozek

(57) ABSTRACT

A wet-laid absorbent sheet includes a mixture of pulp-derived papermaking fibers and synthetic polymer fibers, a strength agent selected from carboxymethylcellulose and anionic starch as well as an epihalohydrin/amine functional wet strength resin. Also included is an anionic olefin copolymer resin effective to increase the wet/dry tensile ratio of the sheet.

41 Claims, 3 Drawing Sheets

U.S. PATENT DOCUMENTS

| | | | | |
|---|---|---|---|---|
| 4,906,513 | A | 3/1990 | Kebbell et al. | 428/198 |
| 4,931,201 | A | 6/1990 | Julemont | 252/91 |
| 5,223,096 | A | 6/1993 | Phan et al. | 162/158 |
| 5,262,007 | A | 11/1993 | Phan et al. | 162/158 |
| 5,264,082 | A | 11/1993 | Phan et al. | 162/158 |
| 5,312,522 | A | 5/1994 | Van Phan et al. | 162/111 |
| 5,415,737 | A | 5/1995 | Phan et al. | 162/111 |
| 5,607,551 | A | 3/1997 | Farrington, Jr. et al. | 162/109 |
| 5,759,926 | A | 6/1998 | Pike et al. | 442/333 |
| 5,895,710 | A | 4/1999 | Sasse et al. | 442/334 |
| 6,573,204 | B1 | 6/2003 | Phillipp et al. | 442/346 |
| 6,624,100 | B1 | 9/2003 | Pike | 442/340 |
| 6,645,618 | B2 | 11/2003 | Hobbs et al. | 428/359 |
| 6,849,329 | B2 | 2/2005 | Perez et al. | 428/359 |
| 6,890,649 | B2 | 5/2005 | Hobbs et al. | 428/365 |
| 6,969,443 | B1 | 11/2005 | Kokko | 162/5 |
| 2002/0168912 | A1 | 11/2002 | Bond et al. | 442/415 |
| 2003/0009141 | A1 | 1/2003 | Graef et al. | 604/368 |
| 2003/0200991 | A1 | 10/2003 | Keck et al. | 134/6 |
| 2003/0203695 | A1 | 10/2003 | Polanco et al. | 442/365 |
| 2004/0144510 | A1* | 7/2004 | Mauler | 162/158 |
| 2004/0203306 | A1 | 10/2004 | Grafe et al. | 442/189 |
| 2004/0238135 | A1 | 12/2004 | Edwards et al. | |
| 2005/0006040 | A1 | 1/2005 | Boettcher et al. | 162/111 |
| 2005/0148264 | A1 | 7/2005 | Varona et al. | 442/382 |
| 2005/0217814 | A1 | 10/2005 | Super et al. | |
| 2005/0241786 | A1 | 11/2005 | Edwards et al. | |
| 2005/0241787 | A1 | 11/2005 | Murray et al. | |
| 2005/0279471 | A1 | 12/2005 | Murray et al. | |
| 2006/0141881 | A1 | 6/2006 | Bergsten et al. | 442/149 |
| 2006/0201644 | A1* | 9/2006 | Hashimoto et al. | 162/146 |
| 2006/0237154 | A1 | 10/2006 | Edwards et al. | |
| 2006/0260774 | A1* | 11/2006 | Rodriguez et al. | 162/135 |
| 2006/0289133 | A1 | 12/2006 | Yeh et al. | |
| 2006/0289134 | A1 | 12/2006 | Yeh et al. | |
| 2007/0204966 | A1 | 9/2007 | Chou et al. | |
| 2008/0029235 | A1 | 2/2008 | Edwards et al. | |
| 2008/0029236 | A1* | 2/2008 | Williams et al. | 162/146 |
| 2008/0264589 | A1 | 10/2008 | Chou et al. | |

FOREIGN PATENT DOCUMENTS

| | | | |
|---|---|---|---|
| WO | 03/037394 | A1 | 5/2003 |

* cited by examiner

ABSORBENT SHEET PREPARED WITH PAPERMAKING FIBER AND SYNTHETIC FIBER EXHIBITING IMPROVED WET STRENGTH

CLAIM FOR PRIORITY

This application is based upon U.S. Provisional Patent Application Ser. No. 61/131,642, of the same title, filed Jun. 11, 2008. The priority of U.S. Patent Application Ser. No. 61/131,642 is hereby claimed and its disclosure incorporated into this application by reference.

TECHNICAL FIELD

The present invention relates to absorbent sheet suitable for use as high performance wipers. The sheets incorporate cellulosic papermaking fiber, synthetic fiber, together with a PAE wet strength resin, a strength agent selected from carboxymethylcellulose and anionic starch as well as a neutralized olefin/carboxylic acid copolymer resin. The wipers exhibit elevated wet strength and surprisingly high wet/dry tensile ratios.

BACKGROUND

Absorbent products useful as high performance wipers are known in the art. U.S. Pat. No. 6,890,649 to Hobbs et al. (3M) discloses polyester microfibers for use in a wiper product. According to the '649 patent the microfibers have an average effective diameter less than 20 microns and generally from 0.01 microns to 10 microns. See column 2, lines 38-40. These microfibers are prepared by fibrillating a film surface and then harvesting the fibers. U.S. Pat. No. 6,849,329 to Perez et al. discloses microfibers for use in cleaning wipes. These fibers are similar to those described in the '649 patent discussed above. U.S. Pat. No. 6,645,618 also to Hobbes et al. also discloses microfibers in fibrous mats such as those used for removal of oil from water or their use as wipers.

United States Patent Publication No. US 2005/0148264 (application Ser. No. 10/748,648) of Varona et al. discloses a wiper with a bimodal pore size distribution. The wiper is made from melt blown fibers as well as coarser fibers and papermaking fibers. See page 2, paragraph 16.

United States Patent Publication No. US 2004/0203306 (application Ser. No. 10/833,229) of Grafe et al. discloses a flexible wipe including a non-woven layer and at least one adhered nanofiber layer. It is noted on page 1, paragraph 9 that the microfibers have a fiber diameter of from about 0.05 microns to about 2 microns. In this patent, the nanofiber webs were evaluated for cleaning automotive dashboards, automotive windows and so forth. For example, see page 8, paragraphs 55, 56.

U.S. Pat. No. 4,931,201 to Julemont discloses a non-woven wiper incorporating melt-blown fiber. U.S. Pat. No. 4,906,513 to Kebbell et al. also discloses a wiper having melt-blown fiber. Here, polypropylene microfibers are used and the wipers are reported to provide streak-free wiping properties. This patent is of general interest as is U.S. Pat. No. 4,436,780 to Hotchkiss et al. which discloses a wiper having a layer of melt-blown polypropylene fibers and on either side a spun bonded polypropylene filament layer. See, also, U.S. Pat. No. 4,426,417 to Meitner et al. which discloses a non-woven wiper having a matrix of non-woven fibers including microfiber and staple fiber. U.S. Pat. No. 4,307,143 to Meitner discloses a low cost wiper for industrial applications which includes thermoplastic, melt-blown fibers.

U.S. Pat. No. 4,100,324 to Anderson et al. discloses a non-woven fabric useful as a wiper which incorporates wood pulp fibers.

United States Patent Publication No. US 2006/0141881 (application Ser. No. 11/361,875) of Bergsten et al. discloses a wipe with melt-blown fibers. This publication also describes a drag test at pages 7 and 9. Note, for example, page 7, paragraph 59. According to the test results on page 9, microfiber increases the drag of the wipe on a surface. United States Patent Publication No. US 2003/0200991 (application Ser. No. 10/135,903) of Keck et al. discloses a dual texture absorbent web.

U.S. Pat. No. 6,573,204 to Philipp et al. discloses a cleaning cloth having a non-woven structure made from micro staple fibers of at least two different polymers and secondary staple fibers bound into the micro staple fibers. The split fiber is reported to have a titer of 0.17 to 3.0 dtex prior to being split. See Col. 2, lines 7 through 9. Note, also, U.S. Pat. No. 6,624,100 to Pike which discloses splitable fiber for use in microfiber webs.

While there have been advances in the art as to high efficiency wipers, existing products tend to be relatively difficult and expensive to produce and are not readily produced on conventional high speed papermachines. Furthermore, products with mixtures of pulp-derived papermaking fibers and synthetic fibers tend to lack strength, especially wet strength, because of poor interfiber bonding. Wipers of this invention exhibit surprising wet strength and are economically produced on conventional equipment such as a CWP papermachine.

SUMMARY OF INVENTION

A wet-laid absorbent sheet includes a mixture of pulp-derived papermaking fibers and synthetic polymer fiber which incorporates an epihalohydrin/amine functional wet-strength resin, a strength agent selected from carboxymethylcellulose and anionic starch as well as an anionic olefin copolymer resin effective to increase the wet/dry tensile ratio of the sheet as compared with a like sheet prepared without the anionic olefin copolymer.

BRIEF DESCRIPTION OF DRAWINGS

The invention is described in detail below with reference to the Figures wherein.

DETAILED DESCRIPTION

Figure 1:
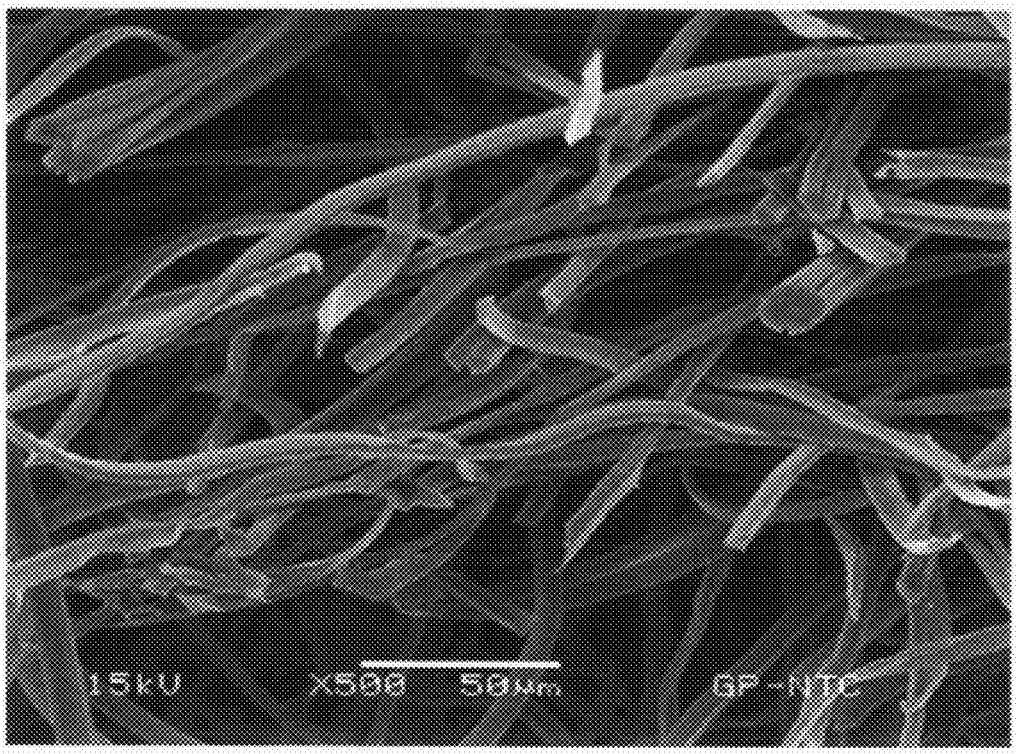
FIG. 1 is a photomicrograph (500×) of split bicomponent fiber.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definitions set forth immediately below; mils refers to thousandths of an inch; mg refers to milligrams and $m^2$ refers to square meters, percent means weight percent (dry basis), "ton" means short ton (2000 pounds) and so forth. Unless otherwise specified, the version of a test method applied is that in effect as of Jan. 1, 2006 and test specimens are prepared under standard TAPPI conditions; that is, conditioned in an atmosphere of 23°±1.0° C. (73.4°±1.8° F.) at 50% relative humidity for at least about 2 hours.

"Anionic resin" and like terminology refer to ionomers with anions in the polymer backbone, for example, carboxylate or sulfonate anions.

Unless otherwise specified, "basis weight", BWT, bwt and so forth refers to the weight of a 3000 square foot ream of product. Consistency refers to percent solids of a nascent web, for example, calculated on a bone dry basis. "Air dry" means including residual moisture, by convention up to about 10 percent moisture for pulp and up to about 6% for paper. A nascent web having 50 percent water and 50 percent bone dry pulp has a consistency of 50 percent.

Sheet calipers and or bulk reported herein may be measured at 8 or 16 sheet calipers as specified. Hand sheet caliper and bulk is based on 5 sheets. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8 mm) diameter anvils, 539±10 grams dead weight load, and 0.231 in./sec descent rate. For finished product testing, each sheet of product to be tested must have the same number of plies as the product when sold. For testing in general, eight sheets are selected and stacked together. For base sheet testing off of winders, each sheet to be tested must have the same number of plies as produced off the winder. For base sheet testing off of the papermachine reel, single plies must be used. Sheets are stacked together aligned in the MD. On custom embossed or printed product, try to avoid taking measurements in these areas if at all possible. Bulk may also be expressed in units of volume/weight by dividing caliper by basis weight (specific bulk).

The term compactively dewatering the web or furnish refers to mechanical dewatering by wet pressing on a dewatering felt, for example, in some embodiments by use of mechanical pressure applied continuously over the web surface as in a nip between a press roll and a press shoe wherein the web is in contact with a papermaking felt. The terminology "compactively dewatering" is used to distinguish processes wherein the initial dewatering of the web is carried out largely by thermal means as is the case, for example, in U.S. Pat. No. 4,529,480 to Trokhan and U.S. Pat. No. 5,607,551 to Farrington et al. Compactively dewatering a web thus refers, for example, to removing water from a nascent web having a consistency of less than 30 percent or so by application of pressure thereto and/or increasing the consistency of the web by about 15 percent or more by application of pressure thereto.

A creping adhesive may be used to secure the web to the Yankee drying cylinder. The adhesive is preferably a hygroscopic, re-wettable, substantially non-crosslinking adhesive. Examples of preferred adhesives are those which include poly(vinyl alcohol) of the general class described in U.S. Pat. No. 4,528,316 to Soerens et al. Other suitable adhesives are disclosed in co-pending U.S. patent application Ser. No. 10/409,042 (Publication No. US 2005-0006040 A1), filed Apr. 9, 2003, entitled "Improved Creping Adhesive Modifier and Process for Producing Paper Products". The disclosures of the '316 patent and the '042 application are incorporated herein by reference. Suitable adhesives are optionally provided with modifiers and so forth. It is preferred to use crosslinker and/or modifier sparingly or not at all in the adhesive.

"Debonder", debonder composition", "softener" and like terminology refer to compositions used for decreasing tensiles or softening absorbent paper products. Typically, these compositions include surfactants as an active ingredient and are further discussed below.

"Denier" refers to fineness of a fiber, g/9000 m. "Characteristic" fineness refers to the fineness of a splittable fiber after it has been cleaved into segments. A 2-denier, 16-segment splittable bicomponent fiber thus has a characteristic fineness of 0.125 denier. Synthetic fibers having characteristic fineness of from 0.01 or less to 1 are generally suitable for use in absorbent sheet of the invention.

A like sheet prepared without carboxylated olefin copolymer and like terminology refers to a sheet made by substantially the same process having substantially the same composition as a sheet made with carboxylated olefin copolymer except that the furnish includes no carboxylated olefin copolymer and substitutes fiber having substantially the same composition as the other fiber in the sheet.

"MD" means machine direction and "CD" means cross-machine direction.

"Predominant" and like terminology means more than 50% by weight.

Dry tensile strengths (MD and CD), stretch, ratios thereof, modulus, break modulus, stress and strain are measured with a standard Instron test device or other suitable elongation tensile tester which may be configured in various ways, typically using 3 or 1 inch wide strips of tissue or towel, conditioned in an atmosphere of 23°±1° C. (73.4°±1° F.) at 50% relative humidity for 2 hours. The tensile test is run at a crosshead speed of 2 in/min. Tensile strength is sometimes referred to simply as "tensile" and is reported in g/3" or g/in or breaking length. Tensile may also be reported as breaking length (km).

The wet tensile of the tissue of the present invention is measured using a one-inch or three-inch wide strip of tissue that is folded into a loop, clamped in a special fixture termed a Finch Cup, then immersed in water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time. Values are divided by two, as appropriate, to account for the loop.

Wet/dry tensile ratios are expressed in percent by multiplying the ratio by 100. For towel products, the wet/dry CD tensile ratio is the most relevant. Throughout this specification and claims which follow "wet/dry ratio" or like terminology refers to the wet/dry CD tensile ratio unless clearly specified otherwise. For handsheets, MD and CD values are approximately equivalent.

The term "cellulosic", "cellulosic fiber" and the like is meant to include any fiber incorporating cellulose as a major constituent. "Papermaking fibers" means cellulosic fibers and includes virgin pulps or recycle (secondary) cellulosic fibers or fiber mixtures comprising reconstituted cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood Kraft fibers; hardwood fibers, such as eucalyptus, maple, birch, aspen, or the like. Papermaking fibers used in connection with the invention include naturally occurring pulp-derived fibers as well as reconstituted cellulosic fibers such as lyocell or rayon. Pulp-derived fibers are liberated from their source material by any one of a number of pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide and so forth. Naturally occurring pulp-derived fibers are referred to herein simply as "pulp-derived" papermaking fibers. The products of the present invention may comprise a blend of conventional fibers (whether derived from virgin pulp or recycle sources) and high coarseness lignin-rich tubular fibers, such as bleached chemical thermomechanical pulp (BCTMP). Pulp-derived fibers thus also include high yield fibers such as BCTMP as well as thermomechanical pulp (TMP), chemithermomechanical pulp (CTMP) and alkaline peroxide mechanical pulp (APMP). "Furnishes" and like terminology refer to aqueous compositions including papermaking fibers, optionally wet strength resins, debonders and the like for making paper products Kraft softwood fiber is low yield fiber made by the well known Kraft (sulfate) pulping process from coniferous material and includes northern and southern softwood Kraft fiber, Douglas fir Kraft fiber and so forth. Kraft softwood fibers generally have a lignin content of less than 5 percent by weight, a length weighted average fiber length of greater than 2 mm, as well as an arithmetic average fiber length of greater than 0.6 mm.

Kraft hardwood fiber is made by the Kraft process from hardwood sources, i.e., eucalyptus and also has generally a lignin content of less than 5 percent by weight. Kraft hardwood fibers are shorter than softwood fibers, typically having a length weighted average fiber length of less than 1.2 mm and an arithmetic average length of less than 0.5 mm or less than 0.4 mm.

Recycle fiber may be added to the furnish in any amount. While any suitable recycle fiber may be used, recycle fiber with relatively low levels of groundwood is preferred in many cases, for example, recycle fiber with less than 15% by weight lignin content, or less than 10% by weight lignin content may be preferred depending on the furnish mixture employed and the application.

"Synthetic polymer fiber" and like terminology refer to fiber made from synthetic polymers such as polyesters, nylons and polyolefins and so forth. Polyesters are generally obtained by known polymerization techniques from aliphatic or aromatic dicarboxylic acids with saturated aliphatic or aromatic diols. Preferred aromatic diacid monomers are the lower alkyl esters such as the dimethyl esters of terephthalic acid or isophthalic acid. Typical aliphatic dicarboxylic acids include adipic, sebacic, azelaic, dodecanedioic acid or 1,4-cyclohexanedicarboxylic acid. The preferred aromatic dicarboxylic acid or its ester or anhydride is esterified or transesterified and polycondensed with the saturated aliphatic or aromatic diol. Typical saturated aliphatic diols preferably include the lower alkane-diols such as ethylene glycol. Typical cycloaliphatic diols include 1,4-cyclohexane diol and 1,4-cyclohexane dimethanol. Typical aromatic diols include aromatic diols such as hydroquinone, resorcinol and the isomers of naphthalene diol (1,5-; 2,6-; and 2,7-). Various mixtures of aliphatic and aromatic dicarboxylic acids and saturated aliphatic and aromatic diols may also be used. Most typically, aromatic dicarboxylic acids are polymerized with aliphatic diols to produce polyesters, such as polyethylene terephthalate (terephthalic acid+ethylene glycol). Additionally, aromatic dicarboxylic acids can be polymerized with aromatic diols to produce wholly aromatic polyesters, such as polyphenylene terephthalate (terephthalic acid+hydroquinone). Examples of polyesters include; polyethylene terephthalate; poly(1,4-butylene)terephthalate; and 1,4-cyclohexylene dimethylene terephthalate/isophthalate copolymer and other linear homopolymer esters derived from aromatic dicarboxylic acids, including isophthalic acid, bibenzoic acid, naphthalene-dicarboxylic acid including the 1,5-; 2,6-; and 2,7-naphthalene-dicarboxylic acids; 4,4,-diphenylene-dicarboxylic acid; bis(p-carboxyphenyl)methane acid; ethylene-bis-p-benzoic acid; 1,4-tetramethylene bis(p-oxybenzoic) acid; ethylene bis(p-tetramethylene acid; 1,3-trimethylene bis(p-oxybenzoic) acid; and 1,4-tetramethylene bis(p-oxybenzoic) acid, and diols selected from the group consisting of 2,2-dimethyl-1,3-propane diol; cyclohexane dimethanol and aliphatic glycols of the general formula $HO(CH_2)_nOH$ where n is an integer from 2 to 10, e.g., ethylene glycol; 1,4-tetramethylene glycol; 1,6-hexamethylene glycol; 1,8-octamethylene glycol; 1,10-decamethylene glycol; and 1,3-propylene glycol; and polyethylene glycols of the general formula $HO(CH_2CH_2O)_nH$ where n is an integer from 2 to 10,000, and aromatic diols such as hydroquinone, resorcinol and the isomers of naphthalene diol (1,5-; 2,6-; and 2,7). There can also be present one or more aliphatic dicarboxylic acids, such as adipic, sebacic, azelaic, dodecanedioic acid or 1,4-cyclohexanedicarboxylic acid.

Suitable polyolefin resins include material made by polymerizing such olefins as ethylene, propylene, butene-1, pentene-1,4-methylpent-1-ene, etc., in conventional manner. Useful polyolefins for fibers are high-density polyethylene (HDPE) and polypropylene. Other polyolefin homopolymers and copolymers of ethylene can be utilized in the practice of this invention. Such other polyolefins include low-density polyethylene (LDPE), very low-density polyethylene (VLDPE), linear low-density polyethylene (LLDPE) and polybutylene (PB). However, these other polyolefins can be blended with other polyolefins such as polypropylene or high-density polyethylene (HDPE).

Nylon or polyamide resins useful in the practice of the invention are well-known in the art and include semi-crystalline and amorphous resins, which may be produced for example by condensation polymerization of equimolar amounts of saturated dicarboxylic acids containing from 4 to 12 carbon atoms with diamines, by ring opening polymerization of lactams, or by copolymerization of polyamides with other components, e.g. to form polyether polyamide block copolymers. Examples of polyamides include polyhexamethylene adipamide (nylon 66), polyhexamethylene azelaamide (nylon 69), polyhexamethylene sebacamide (nylon 610), polyhexamethylene dodecanoamide (nylon 612), polydodecamethylene dodecanoamide (nylon 1212), polycaprolactam (nylon 6), polylauric lactam, poly-11-aminoundecanoic acid, and copolymers of adipic acid, isophthalic acid, and hexamethylene diamine.

Synthetic polymer fibers are generally hydrophobic as compared with cellulose and lack anionic sites for bonding to wet strength resins or enough hydroxyl groups to hydrogen bond effectively to pulp-derived fiber. Suitable fibers used in connection with this invention include melt-spun fibers, melt-blown fibers, splittable fibers having multiple segments and especially segmented bicomponent fibers which are splittable into their segments by refining in a disk refiner. One suitable fiber available from Fiber Innovation Technology is a 16-segment, 2-denier nylon/polyester bicomponent fiber having a characteristic fineness of 0.125 denier, discussed below.

Segmented fiber preparation for making splittable fibers is generally known in connection with thermoplastic fibers, where fibers having segments formed of different polymers. See, for example, U.S. Pat. No. 5,759,926 to Pike et al., as well as U.S. Pat. No. 5,895,710 to Sasse et al. and United States Patent Application Publication No. 2003/0203695 (U.S. patent application Ser. No. 10/135,650) of Polanco et al., the disclosures of which are incorporated herein by reference.

The splittable fibers produced and utilized in connection with this invention may have a segmented pie shape, an island in the sea configuration, a side-by-side configuration, a hollow configuration and so forth. See U.S. Pat. No. 4,735,849 to Murakami et al., FIGS. 6A-6D, as well as United States Patent Application Publication No. US 2002/0168912 (U.S. patent application Ser. No. 09/852,888), FIGS. 2-9. The disclosures of U.S. Pat. No. 4,735,849 and Publication No. US 2002/0168912 are incorporated herein by reference in their entireties. Splittable fibers are suitably disintegrated prior to incorporarion into the furnish as is discussed below.

Prior to sheet-forming, a fiber mixture or the cellulosic fiber alone may be treated with a debonder. Debonder compositions are typically comprised of cationic or anionic amphiphilic compounds, or mixtures thereof (hereafter referred to as surfactants) combined with other diluents and non-ionic amphiphilic compounds; where the typical content of surfactant in the debonder composition ranges from about 10 wt % to about 90 wt %. Diluents include propylene glycol, ethanol, propanol, water, polyethylene glycols, and nonionic amphiphilic compounds. Diluents are often added to the surfactant package to render the latter more tractable (i.e., lower viscosity and melting point). Some diluents are artifacts of the surfactant package synthesis (e.g., propylene glycol). Nonionic amphiphilic compounds, in addition to controlling composition properties, can be added to enhance the wettability of the debonder, where both debonding and maintenance of absorbency properties are critical to the substrate that a debonder is applied. The nonionic amphiphilic compounds can be added to debonder compositions to disperse inherent water immiscible surfactant packages in water streams, such as encountered during papermaking. Alternatively, the nonionic amphiphilic compound, or mixtures of different non-ionic amphiphilic compounds, as indicated in U.S. Pat. No. 6,969,443 to Kokko, can be carefully selected to predictably adjust the debonding properties of the final debonder composition.

Quaternary ammonium compounds, such as dialkyl dimethyl quaternary ammonium salts are suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

After debonder treatment, the pulp is mixed with an epihalohydrin/amine-functional wet strength resin and a strength agent selected from carboxymethylcellulose, anionic starch and so forth before the sheet is formed. Suitable epichlorohydrin/amine-functional wet strength resins are known to the skilled artisan and include polyamine-epichlorohydrin resins as well as polyamide-amine epichlorohydrin resins, collectively referred to herein as "PAE resins" or with like terminology. Examples of these materials are described in U.S. Pat. Nos. 3,772,076; 3,700,623; 2,926,154 and 2,926,116 to Keim the disclosures of which are incorporated herein by reference. Suitable PAE wet strength resins are sold under the trade names Kymene® by Hercules Incorporated of Wilmington, Del. and Amres® by Georgia-Pacific Resins, Inc. Other classes of suitable epichlorohydrin/amine-functional wet strength resins may include polyaminoureylene/epichlorohydrin resins and the like as is described in U.S. Pat. No. 3,240,664 to Earle, the disclosure of which is also incorporated herein by reference. An extensive description of polymeric-epihalohydrin resins is given in Chapter 2: *Alkaline-Curing Polymeric Amine-Epichlorohydrin* by Espy in *Wet Strength Resins and Their Application* (L. Chan, Editor, 1994) incorporated by reference in its entirety.

In accordance with the invention, an anionic polyolefin copolymer is added to the papermaking furnish in order to improve sheet strength, especially wet strength. Without intending to be bound by any theory, it is believed the anionic polyolefin copolymer interacts with both the wet strength resin and the synthetic fiber, making the wet strength resin much more effective in preserving wet strength of the synthetic fiber/cellulose fiber blend in the sheet.

The anionic polyolefin copolymer resin may be based on one or more of propylene monomer, butene monomer or hexene monomer, for example; but is preferably based on ethylene. The olefin monomer is polymerized with one or more of the following unsaturated monomers:

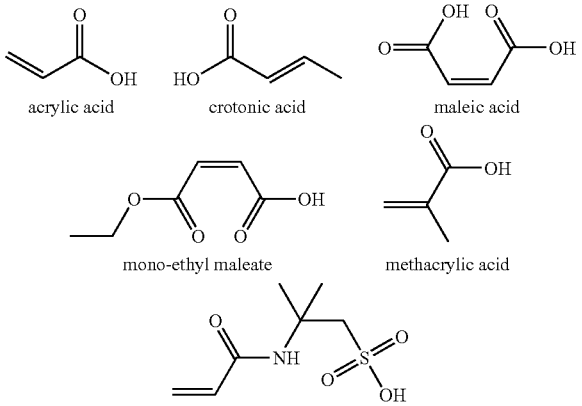

Suitable ethylene/acrylic acid polymers are available from Dow Chemical, sold in connection with the PRIMACOR® trademark. The resin is neutralized before use in the furnish; that is, it is added to the furnish in anionic (salt) form as described in the Examples below. Particular resins may have an acrylic acid functionality of from 1 mol % to 40 mol % such as from 3 mol % to 40 mol % acrylic acid monomer, as well as a melt index of from 100-600.

Strength agents which may be added include anionic starch and carboxymethyl cellulose (CMC). CMC has been found particularly effective, an example of which is sold under the trade name Hercules CMC, by Hercules Incorporated of Wilmington, Del. As one of skill in the art will appreciate, CMC is a semi-synthetic, water soluble polymer in which $CH_2COOH$ groups are substituted on the glucose units of the cellulose chain through an ether linkage. Since the reaction occurs under alkaline conditions, the product includes the sodium salt.

Preferably, the wipers of this invention are substantially free of latex binder resin, i.e., less than 3%, suitably less than 1% and preferably no latex binder at all. Latex binder makes it difficult or impossible to re-pulp the sheet.

EXAMPLES

One preferred bicomponent is a polyester/nylon 16 segment pie-wedge cross-section having a denier of 2 g/9000 m.

The fiber is cut to 2 mm and processed in a Jordan refiner prior to use. A typical batch was about 8.3 lb fiber in 400 gallons of water (0.25% consistency) with 4 net HP applied for about 45 minutes. 10 ppm Rhodameen® dispersant was added. Table 1 shows the average FQA parameters (OpTest Equipment, Hawkesbury, Ontario, Canada) after splitting in the Jordan. Fiber length was significantly shortened in the splitting process. FIG. 1 shows that a high level of splitting was achieved.

TABLE 1

Average FQA Parameters for Split Bicomponent Fiber

| FQA Fib Len Ln mm | FQA Fib Len Lw mm | FQA Fib Len Lz mm | FQA Fine Len Ln % | FQA Fine Len Lw % | FQA Curl Ind Ln | FQA Curl Ind Lw | FQA Kink Index | FQA Kink Angle degree | Kinks/ mm Kinks/ mm | FQA Fiber Width um |
|---|---|---|---|---|---|---|---|---|---|---|
| 0.51 | 0.99 | 1.35 | 36 | 7.1 | 0.33 | 0.35 | 3.4 | 79 | 1.4 | 15 |

Handsheet Procedure and Resin Preparation

A 5 g (oven dry weight) sample of micro fibrillated nylon/polyester bicomponent fibers was dispersed in 240 mL deionized water with or without (Control) a given dosage of a 3.84 wt % solution of PRIMACOR® 5980 sodium salt in water (prepared by heating to 90° C. with stirring PRIMACOR® 5980 with an equivalent of sodium hydroxide for about 30 min). PRIMACOR® 5980 is believed similar to PRIMACOR® 5980I which has 20% acrylic acid, a melt index of 300 and a density of 0.958 g/ml. The pH was lowered from the resultant pH of about 9.5 to 8.1-8.4 using dilute sulfuric acid. A separate sample of 5 g (oven dry weight) unrefined bleached softwood Kraft (reconstituted from dry-lap pulp by soaking overnight in water and disintegrating for 5 min in 2 L water in a British disintegrator) was dispersed in 150 mL water and treated with a given amount of a 1.62 wt % solution of CMC-7MT (Hercules) in water. The two pulp slurries were combined and then treated with a given amount of a 1 wt % solution of AMRES® 100HP and stirred for 5 min before diluting to 8 L with water and subsequently preparing handsheets. The latter were made to a target basis weight of about 40 #/rm, pressed at 15 psi/5 min, dried in a drum dryer at 250° F., and cured in a forced air oven at 105° C./5 min. The resultant sheets were tested for dry and wet tensiles, basis weight and caliper using standard methods. The furnish charge was determined by titration with a 0.001 M solution of Poly-diallyl dimethyl ammonium chloride (Poly-DADMAC) with a Mutek charge analyzer. Further details and results appear in Table 2 below and are presented graphically in FIGS. 2 and 3.

TABLE 2

Sheet Resin Components and Properties 50:50 Softwood Kraft:Synthetic Fiber

| Run | Amres 100HP, #/T | Primacor-Na Salt (#/T) | CMC. #T | Titratable Charge mL/ 10 mL $10^{-3}$ N | Basis Weight #R | Basis Weight g/m$^2$ | Bulk Caliper, mils | Bulk Bulk, cm$^3$/g | Dey Tensile g/l" | Dey Tensile Breaking Length, km | Wet Tensile g/l" | Wet Tensile Breaking Length, km | W/D Tensile Ratio |
|---|---|---|---|---|---|---|---|---|---|---|---|---|---|
| 1 | 11.4 | 9.98 | 2.49 | −0.09 | 39.39 | 64.11 | 9.85 | 3.90 | 1580 | 0.970 | 765.11 | 0.470 | 0.48 |
| 2 | 59.5 | 9.98 | 27.2 | −0.13 | 41.68 | 67.83 | 9.346 | 3.50 | 4048 | 2.349 | 2774.45 | 1.610 | 0.69 |
| 3 | 59.5 | 29.95 | 27.2 | −0.36 | 42.04 | 68.42 | 10.104 | 3.75 | 3077 | 1.771 | 2136.86 | 1.230 | 0.69 |
| 4 | 33.8 | 29.95 | 13.6 | −0.36 | 41.31 | 67.23 | 10.018 | 3.78 | 2350 | 1.376 | 1618.4 | 0.948 | 0.69 |
| 5 | 33.8 | 0 | 13.6 | −0.11 | 42.14 | 68.58 | 10.164 | 3.76 | 2504 | 1.437 | 1228.71 | 0.705 | 0.49 |
| 6 | 59.5 | 0 | 27.2 | −0.08 | 42.07 | 68.47 | 10.286 | 3.82 | 3336 | 1.918 | 1613.06 | 0.928 | 0.48 |

Figure 2:
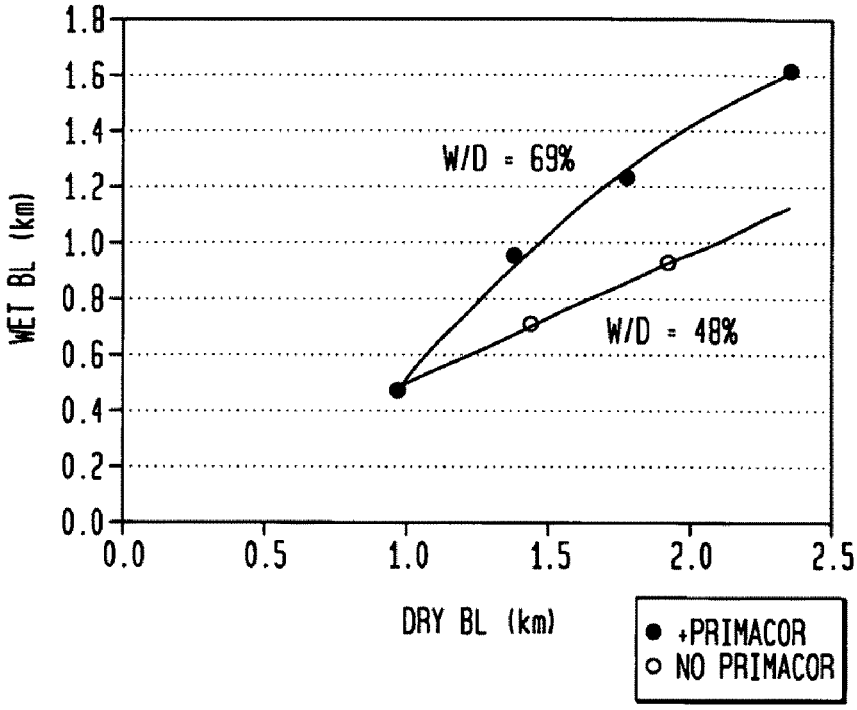
FIG. 2 is a plot of wet vs. dry tensile strength for handsheets containing 50:50 synthetic and softwood Kraft fibers and treated with various dosages of wet strength resins and carboxymethylcellulose with and without various dosages of ethylene/acrylic acid copolymer-sodium salt.
Figure 3:
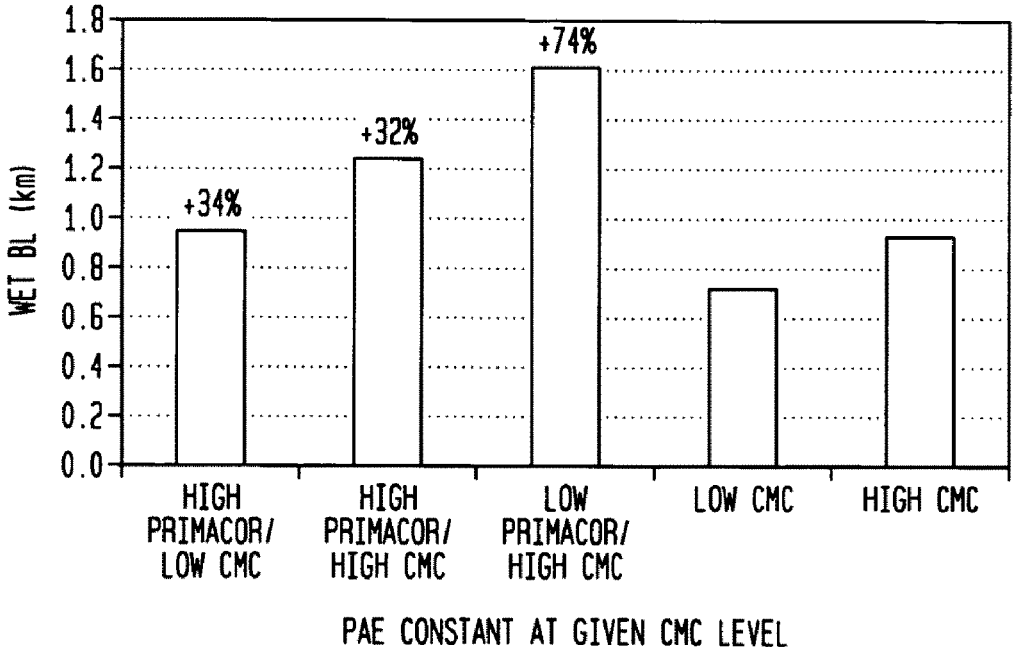
FIG. 3 is a bar chart of wet tensile strength for handsheets containing 50:50 synthetic and softwood Kraft fibers and treated with various dosages of wet strength resins and carboxymethylcellulose at two different dosages of ethylene/acrylic acid copolymer-sodium salt as well as controls without ethylene/acrylic acid copolymer, where the wet strength level is constant at a given CMC level; that is, the dosage of PAE and CMC in a given control (e.g., high) is identical to a given treatment with ethylene/acrylic acid copolymer-sodium salt with a same qualitative CMC level. The percentages on top of bars are the gains in wet tensile over corresponding controls.

It is seen in the data that the products with a neutralized carboxylated olefin resin exhibit surprising wet strength and wet/dry ratios. Without intending to be bound by any theory, it is hypothesized that a polyethylene having a paucity of carboxyl groups (i.e., PRIMACOR® 5980) is sufficiently hydrophobic enough under papermaking conditions that it preferentially adsorbs onto the synthetic fiber surfaces making the latter anionic and, therefore, reactive with a PAE wet strength resin. As seen in FIG. 2, treating mixed furnishes of bicomponent fiber and softwood Kraft fibers with the combination of PRIMACOR/CMC/PAE resulted in a significant gain in absolute wet tensile at a given dry tensile relative to treatments without the PRIMACOR®. Indeed, a 69% W/D ratio was achieved with the inclusion of PRIMACOR® compared with a 48% W/D ratio with CMC/PAE alone.

Generally, the absorbent sheet includes: (a) from about 90% to about 25% by weight pulp-derived papermaking fiber; (b) from about 10% to about 75% by weight synthetic polymer fiber; (c) a wet strength resin in an amount of from about 5 lbs/ton to about 100 lbs/ton based on the dry weight of fiber in the sheet; (d) a strength agent selected from carboxymethyl cellulose and anionic starch; and (e) from about 5 lbs/ton to about 75 lbs/ton of an anionic olefin copolymer resin based on the dry weight of fiber in the sheet, wherein the sheet exhibits a wet/dry tensile ratio of at least 40%. The sheet may be produced on conventional paper tissue and paper towel papermaking machines without any substantial modifications thereto.

Figure 4:
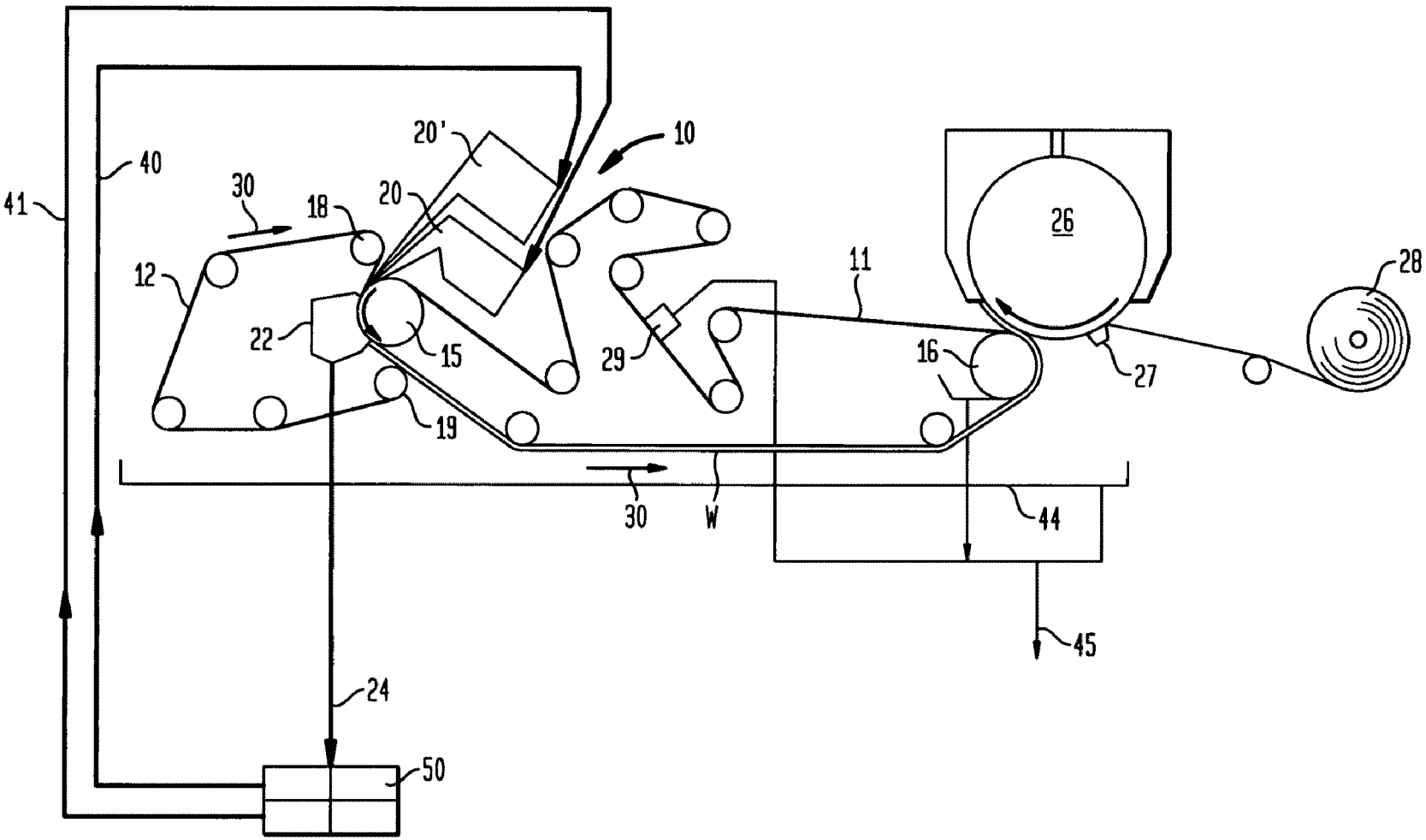
FIG. 4 is a schematic diagram of a wet-press paper machine which may be used in the practice of the present invention.

FIG. 4 illustrates one way of practicing the present invention where a machine chest 50, which may be compartmentalized, is used for preparing suitable furnishes. This embodiment shows a divided headbox thereby making it possible to produce a stratified product. The product according to the present invention can be made with single or multiple headboxes, 20, 20' and regardless of the number of headboxes may be stratified or unstratified. A layer may embody the sheet characteristics described herein in a multilayer structure wherein other strata do not. The treated furnish is transported through different conduits 40 and 41, where it is delivered to the headbox of a crescent forming machine 10 as is well known, although any convenient configuration can be used.

FIG. 4 shows a web-forming end or wet end with a liquid permeable foraminous support member 11 which may be of any convenient configuration. Foraminous support member 11 may be constructed of any of several known materials including photopolymer fabric, felt, fabric or a synthetic filament woven mesh base with a very fine synthetic fiber batt attached to the mesh base. The foraminous support member 11 is supported in a conventional manner on rolls, including breast roll 15, and pressing roll, 16.

Forming fabric 12 is supported on rolls 18 and 19 which are positioned relative to the breast roll 15 for guiding the forming wire 12 to converge on the foraminous support member 11 at the cylindrical breast roll 15 at an acute angle relative to the foraminous support member 11. The foraminous support member 11 and the wire 12 move at the same speed and in the same direction which is the direction of rotation of the breast roll 15. The forming wire 12 and the foraminous support member 11 converge at an upper surface of the forming roll 15 to form a wedge-shaped space or nip into which one or more jets of water or foamed liquid fiber dispersion may be injected and trapped between the forming wire 12 and the foraminous support member 11 to force fluid through the wire 12 into a save-all 22 where it is collected for re-use in the process (recycled via line 24).

The nascent web W formed in the process is carried along the machine direction 30 by the foraminous support member 11 to the pressing roll 16 where the wet nascent web W is transferred to the Yankee dryer 26. Fluid is pressed from the wet web W by pressing roll 16 as the web is transferred to the Yankee dryer 26 where it is dried and creped by means of a creping blade 27. The finished web is collected on a take-up roll 28.

A pit 44 is provided for collecting water squeezed from the furnish by the press roll 16, as well as collecting the water removed from the fabric by a Uhle box 29. The water collected in pit 44 may be collected into a flow line 45 for separate processing to remove surfactant and fibers from the water and to permit recycling of the water back to the papermaking machine 10.

Instead of a conventional wet-press process, a wet-press, fabric creping process may be employed to make the inventive wipers. Preferred aspects of processes including fabric-creping are described in the following co-pending applications: U.S. patent application Ser. No. 11/804,246 (Publication No. US 2008-0029235), filed May 16, 2007, entitled "Fabric Creped Absorbent Sheet with Variable Local Basis Weight"; U.S. patent application Ser. No. 11/678,669 (Publication No. US 2007-0204966), filed Feb. 26, 2007, entitled "Method of Controlling Adhesive Build-Up on a Yankee Dryer"; U.S. patent application Ser. No. 11/451,112 (Publication No. US 2006-0289133), filed Jun. 12, 2006, entitled "Fabric-Creped Sheet for Dispensers"; U.S. patent application Ser. No. 11/451,111, filed Jun. 12, 2006 (Publication No. US 2006-0289134), entitled "Method of Making Fabric-creped Sheet for Dispensers"; U.S. patent application Ser. No. 11/402,609 (Publication No. US 2006-0237154), filed Apr. 12, 2006, entitled "Multi-Ply Paper Towel With Absorbent Core"; U.S. patent application Ser. No. 11/151,761, filed Jun. 14, 2005 (Publication No. US 2005/0279471), entitled "High Solids Fabric-Crepe Process for Producing Absorbent Sheet with In-Fabric Drying"; U.S. patent application Ser. No. 11/108,458, filed Apr. 18, 2005 (Publication No. US 2005-0241787), entitled "Fabric-Crepe and In Fabric Drying Process for Producing Absorbent Sheet"; U.S. patent application Ser. No. 11/108,375, filed Apr. 18, 2005 (Publication No. US 2005-0217814), entitled "Fabric-Crepe/Draw Process for Producing Absorbent Sheet"; U.S. patent application Ser. No. 11/104,014, filed Apr. 12, 2005 (Publication No. US 2005-0241786), entitled "Wet-Pressed Tissue and Towel Products With Elevated CD Stretch and Low Tensile Ratios Made With a High Solids Fabric-Crepe Process"; U.S. patent application Ser. No. 10/679,862 (Publication No. US 2004-0238135), filed Oct. 6, 2003, entitled "Fabric-Crepe Process for Making Absorbent Sheet"; U.S. patent application Ser. No. 12/033,207 (Publication No. US 2008-0264589), filed Feb. 19, 2008, entitled "Fabric Crepe Process With Prolonged Production Cycle"; GP-06-16). The applications referred to immediately above are particularly relevant to the selection of machinery, materials, processing conditions and so forth as to fabric creped products of the present invention and the disclosures of these applications are incorporated herein by reference.

There is thus provided in one aspect of the invention a wet-laid absorbent sheet comprising a mixture of pulp-derived papermaking fibers and synthetic polymer fibers which incorporates an epihalohydrin/amine functional wet-strength resin, a strength agent selected from carboxymethylcellulose and anionic starch as well as an anionic olefin copolymer resin effective to increase the wet/dry tensile ratio of the sheet as compared with a like sheet prepared without the anionic olefin copolymer. A preferred wet strength resin is a PAE resin is selected from polyamine-epichlorohydrin resins and polyamide-amine epichlorohydrin resins, while a preferred accompanying strength agent is carboxymethyl cellulose. Typically, the anionic olefin copolymer is a carboxylated olefin copolymer which incorporates the residue of one or more of: ethylene, propylene, butene or hexene such as a carboxylated olefin copolymer of ethylene/acrylic acid with from about 1 to about 40 mol percent carboxylated monomer residue, such as from about 3 to about 30 mol percent carboxylated monomer residue or from 5 to about 25 mol percent carboxylated monomer residue. These features are likewise optionally employed in the aspects and embodiments described below.

The cellulosic papermaking fiber in the sheet is predominantly pulp-derived papermaking fiber in most cases, and may consist of pulp-derived papermaking fiber; while the synthetic fiber may comprise polyester fiber, nylon fiber, polyolefin fiber or mixtures thereof having a characteristic fineness of less than 1 denier such as a characteristic fineness of less than 0.5 denier or a characteristic fineness of less than 0.25 denier; suitably, the synthetic fiber has a characteristic fineness of from 0.05 denier to 0.2 denier.

In one embodiment, the synthetic fiber comprises splittable synthetic fiber which has been at least partially cleaved into finer fiber. The synthetic fiber in the sheet may be derived from melt-spun bicomponent fiber such as nylon/polyester bicomponent fiber, nylon/polyolefin bicomponent fiber or polyester/polyolefin bicomponent fiber.

Alternatively, the synthetic fiber comprises melt-blown synthetic fiber having a characteristic fineness of less than 0.25 denier.

In another aspect of the invention, there is provided an absorbent sheet comprising: (a) from about 90% to about 25% by weight pulp-derived papermaking fiber; (b) from about 10% to about 75% by weight synthetic polymer fiber; (c) a wet strength resin in an amount of from about 5 lbs/ton to about 100 lbs/ton based on the dry weight of fiber in the sheet; (d) a strength agent selected from carboxymethyl cellulose and anionic starch; and (e) from about 5 lbs/ton to about 75 lbs/ton of an anionic olefin copolymer resin based on the dry weight of fiber in the sheet, wherein the sheet exhibits a wet/dry tensile ratio of at least 40%. Generally, speaking, the sheet exhibits a wet/dry tensile ratio of at least 50%, preferably the sheet exhibits a wet/dry tensile ratio of at least 60% or at least 65%. In most cases the sheet exhibits a wet/dry tensile ratio of from 40% to 80%.

The sheet may comprise various fiber mixtures such as from about 80% by weight to about 30% by weight pulp-derived papermaking fiber and about 20% by weight to about 70% by weight synthetic polymer fiber or about 70% by weight to about 35% by weight pulp-derived papermaking fiber and about 30% by weight to about 65% by weight synthetic polymer fiber. In some cases the sheet comprises from about 60% by weight to about 40% by weight pulp-derived papermaking fiber and about 40% by weight to about 60% by weight synthetic polymer fiber.

In many embodiments, including those described above and below, the pulp-derived papermaking fiber in the sheet is at least 10% by weight softwood Kraft fiber, at least 20% by weight softwood Kraft fiber, at least 30% by weight softwood Kraft fiber or at least 50% by weight softwood Kraft fiber. Suitably, the pulp-derived papermaking fiber in the sheet is from 10% to 75% by weight softwood Kraft fiber.

Typical add-ons include from about 10 lbs/ton to about 75 lbs/ton of wet strength resin based on the dry weight of fiber in the sheet, from about 10 lbs/ton to about 50 lbs/ton of anionic olefin copolymer resin based on the dry weight of fiber in the sheet or from about 20 lbs/ton to about 35 lbs/ton of anionic olefin copolymer resin based on the dry weight of fiber in the sheet. Carboxymethyl cellulose may be added in amounts of from about 1 lb/ton to about 60 lbs/ton such as from 2 lbs/ton to about 30 or 50 lbs/ton based on the dry weight of fiber in the sheet.

In still another aspect of the invention, there is provided a method of making absorbent sheet comprising: (a) preparing an aqueous furnish with a fiber mixture including from about 90% by weight to about 25% by weight of a pulp-derived papermaking fiber, from about 10% by weight to about 75% by weight of synthetic polymer fiber, the furnish also including a wet strength resin, a strength agent selected from carboxymethyl cellulose and anionic starch as well as an anionic olefin copolymer; (b) depositing the aqueous furnish on a foraminous support to form a nascent web and at least partially dewatering the nascent web; and (c) drying the web to provide absorbent sheet. This process employs an aqueous furnish having a consistency of 5% or less, more preferably an aqueous furnish having a consistency of 3% or less and still more preferably an aqueous furnish having a consistency of 2% or less. In most cases the aqueous furnish has a consistency of 1% or less and the nascent web is compactively dewatered with a papermaking felt. A compactively dewatered web may be applied to a Yankee dryer and creped therefrom or a compactively dewatered web is applied to a rotating cylinder and fabric-creped therefrom. In some cases the nascent web is at least partially dewatered by throughdrying or the nascent web is at least partially dewatered by impingement air drying. The fiber mixture may include softwood Kraft and hardwood Kraft.

In still yet another aspect of the invention there is provided a method of making absorbent sheet comprising: (a) comminuting a splittable synthetic polymer fiber; (b) preparing an aqueous furnish with a wet strength resin, a strength agent selected from carboxymethyl cellulose and anionic starch, an anionic carboxylated olefin copolymer, the comminuted synthetic polymer fiber of step (a), and pulp derived papermaking fiber; (c) depositing the aqueous furnish on a foraminous support to form a nascent web and at least partially dewatering the nascent web; and (d) drying the web to provide absorbent sheet as is apparent from the foregoing description. The materials employed in the process may be selected from any of those specified above.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. An absorbent sheet comprising:

(a) from about 90% to about 25% by weight pulp-derived papermaking fiber;

(b) from about 10% to about 75% by weight synthetic polymer fiber;

(c) an epihalohydrin/amine functional wet strength resin in an amount of from about 5 lbs/ton to about 100 lbs/ton based on the dry weight of fiber in the sheet;

(d) a strength agent selected from carboxymethylcellulose and anionic starch; and (e) from about 5 lbs/ton to about 75 lbs/ton of an anionic olefin copolymer resin based on the dry weight of fiber in the sheet, wherein the sheet exhibits a wet/dry tensile ratio of at least 40%.

2. The absorbent sheet according to claim 1, wherein the sheet exhibits a wet/dry tensile ratio of at least 50%.

3. The absorbent sheet according to claim 1, wherein the sheet exhibits a wet/dry tensile ratio of at least 60%.

4. The absorbent sheet according to claim 1, wherein the sheet exhibits a wet/dry tensile ratio of at least 65%.

5. The absorbent sheet according to claim 1, wherein the sheet exhibits a wet/dry tensile ratio of from 40% to 80%.

6. The absorbent sheet according to claim 1, wherein the sheet comprises from about 80% by weight to about 30% by weight pulp-derived papermaking fiber and about 20% by weight to about 70% by weight synthetic polymer fiber.

7. The absorbent sheet according to claim 1, wherein the sheet comprises from about 70% by weight to about 35% by weight pulp-derived papermaking fiber and about 30% by weight to about 65% by weight synthetic polymer fiber.

8. The absorbent sheet according to claim 1, wherein the sheet comprises from about 60% by weight to about 40% by weight pulp-derived papermaking fiber and about 40% by weight to about 60% by weight synthetic polymer fiber.

9. The absorbent sheet according to claim 1, wherein the pulp-derived papermaking fiber in the sheet is at least 10% by weight softwood Kraft fiber.

10. The absorbent sheet according to claim 1, wherein the pulp-derived papermaking fiber in the sheet is at least 20% by weight softwood Kraft fiber.

11. The absorbent sheet according to claim 1, wherein the sheet includes from about 10 lbs/ton to about 75 lbs/ton of wet strength resin based on the dry weight of fiber in the sheet.

12. The absorbent sheet according to claim 1, wherein the sheet contains from about 10 lbs/ton to about 50 lbs/ton of anionic olefin copolymer resin based on the dry weight of fiber in the sheet.

13. The absorbent sheet according to claim 1, wherein the sheet contains from about 20 lbs/ton to about 35 lbs/ton of anionic olefin copolymer resin based on the dry weight of fiber in the sheet.

14. A method of making absorbent sheet comprising:

(a) preparing an aqueous furnish with a fiber mixture including from about 90% by weight to about 25% by weight of a pulp-derived papermaking fiber, the fiber mixture also including from about 10% by weight to about 75% by weight of synthetic polymer fiber, the furnish also including an epihalohydrin/amine functional wet strength resin in an amount of from about 5 lbs/ton to about 100 lbs/ton based on the dry weight of fiber in the sheet, a strength agent selected from carboxymethylcellulose and anionic starch as well as an anionic olefin copolymer resin in an amount of from about 5 lbs/ton to about 75 lbs/ton;

(b) depositing the aqueous furnish on a foraminous support to form a nascent web and at least partially dewatering the nascent web; and (c) drying the web to provide absorbent sheet.

15. The absorbent sheet according to claim 1, wherein the strength agent is carboxymethylcellulose.

16. The absorbent sheet according to claim 1, wherein the strength agent is anionic starch.

17. A wet-laid absorbent sheet comprising a mixture of pulp-derived papermaking fibers in an amount of from about 90% to about 25% by weight and synthetic polymer fibers in an amount of from about 10% to about 75% by weight which incorporates an epihalohydrin/amine functional wet-strength resin in an amount of from about 5 lbs/ton to about 100 lbs/ton based on the dry weight of fiber in the sheet, a strength agent selected from carboxymethyl-cellulose and anionic starch as well as an anionic olefin copolymer resin in an amount of from about 5 lbs/ton to about 75 lbs/ton to increase the wet/dry tensile ratio of the sheet as compared with a like sheet prepared without the anionic olefin copolymer.

18. The wet-laid absorbent sheet according to claim 17, wherein the wet strength resin is a PAE resin.

19. The wet-laid absorbent sheet according to claim 17, wherein the wet strength resin is a polyamine-epichlorohydrin resin.

20. The wet-laid absorbent sheet according to claim 17, wherein the wet strength resin is a polyamide-amine epichlorohydrin resin.

21. The wet-laid absorbent sheet according to claim 17, wherein the strength agent is carboxymethylcellulose.

22. The wet-laid absorbent sheet according to claim 17, wherein the anionic olefin copolymer incorporates the neutralized residue of one or more of:

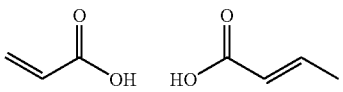

acrylic acid crotonic acid

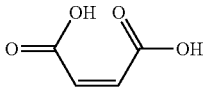

maleic acid

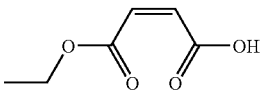

mono-ethyl maleate

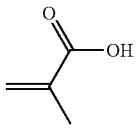

methacrylic acid

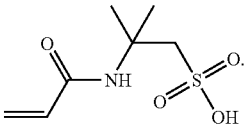

2-acrylamido-2-methyl-1-propanesulfonic acid

23. The wet-laid absorbent sheet according to claim 22, wherein the anionic olefin copolymer is a carboxylated olefin copolymer which incorporates the residue of one or more of: ethylene, propylene, butene or hexene.

24. The wet-laid absorbent sheet according to claim 23, wherein the carboxylated olefin copolymer is an ethylene/acrylic acid copolymer.

25. The wet-laid absorbent sheet according to claim 24, wherein the carboxylated olefin copolymer comprises from about 1 to about 40 mol percent carboxylated monomer residue.

26. The wet-laid absorbent sheet according to claim 25, wherein the carboxylated olefin copolymer comprises from about 3 to about 30 mol percent carboxylated monomer residue.

27. The wet-laid absorbent sheet according to claim 26, wherein the carboxylated olefin copolymer comprises from 5 to about 25 mol percent carboxylated monomer residue.

28. The wet-laid absorbent sheet according to claim 22, wherein the cellulosic papermaking fiber in the sheet is predominantly pulp-derived papermaking fiber.

29. The wet-laid absorbent sheet according to claim 17, wherein the cellulosic papermaking fiber consists of pulp-derived papermaking fiber.

30. The wet-laid absorbent sheet according to claim 17, wherein the synthetic fiber comprises polyester fiber, nylon fiber, polyolefin fiber or mixtures thereof.

31. The wet-laid absorbent sheet according to claim 17, wherein the synthetic fiber has a characteristic fineness of less than 1 denier.

32. The wet-laid absorbent sheet according to claim 17, wherein the synthetic fiber has a characteristic fineness of less than 0.5 denier.

33. The wet-laid absorbent sheet according to claim 17, wherein the synthetic fiber has a characteristic fineness of less than 0.25 denier.

34. The wet-laid absorbent sheet according to claim 17, wherein the synthetic fiber has a characteristic fineness of from 0.05 denier to 0.2 denier.

35. The wet-laid absorbent sheet according to claim 17, wherein the synthetic fiber comprises splittable synthetic fiber which has been at least partially cleaved into finer fiber.

36. The wet-laid absorbent sheet according to claim 17, wherein the synthetic fiber in the sheet is derived from melt-spun bicomponent fiber.

37. The wet-laid absorbent sheet according to claim 36, wherein the melt-spun bicomponent fiber is a nylon/polyester bicomponent fiber.

38. The wet-laid absorbent sheet according to claim 36, wherein the melt-spun bicomponent fiber is a nylon/polyolefin bicomponent fiber.

39. The wet-laid absorbent sheet according to claim 36, wherein the melt-spun bicomponent fiber is a polyester/polyolefin bicomponent fiber.

40. The wet-laid absorbent sheet according to claim 17, wherein the synthetic fiber comprises melt-blown synthetic fiber.

41. The wet-laid absorbent sheet according to claim 40, wherein the melt-blown synthetic fiber has a characteristic fineness of less than 0.25 denier.

* * * * *